US010476163B2

(12) United States Patent
Chen

(10) Patent No.: US 10,476,163 B2
(45) Date of Patent: Nov. 12, 2019

(54) ULTRA-SMALL PLANAR ANTENNAS

(71) Applicant: TAOGLAS GROUP HOLDINGS LIMITED, Enniscorthy, County Wexford (IE)

(72) Inventor: Ming Wei Chen, New Taipei (TW)

(73) Assignee: TAOGLAS GROUP HOLDINGS LIMITED, Enniscorthy, County Wexford (IE)

( * ) Notice: Subject to any disclaimer, the term of this patent is extended or adjusted under 35 U.S.C. 154(b) by 0 days.

(21) Appl. No.: 15/701,890

(22) Filed: Sep. 12, 2017

(65) Prior Publication Data

US 2018/0076527 A1 Mar. 15, 2018

Related U.S. Application Data

(60) Provisional application No. 62/393,273, filed on Sep. 12, 2016.

(51) Int. Cl.
*H01Q 9/04* (2006.01)
*H01Q 1/22* (2006.01)
(Continued)

(52) U.S. Cl.
CPC ..... *H01Q 9/0407* (2013.01); *H01Q 1/2291* (2013.01); *H01Q 1/36* (2013.01);
(Continued)

(58) Field of Classification Search
CPC .... H01Q 9/0407; H01Q 5/328; H01Q 1/2291; H01Q 1/38; H01Q 9/065; H01Q 13/08
(Continued)

(56) References Cited

U.S. PATENT DOCUMENTS 6,081,242 A * 6/2000 Wingo ..... H01Q 1/242 333/32
6,140,977 A * 10/2000 Morales ..... H01Q 1/50 343/702

(Continued)

FOREIGN PATENT DOCUMENTS

WO 9627219 A1 9/1996

OTHER PUBLICATIONS

"Compact Integrated Antennas", Application Note, Freescale Semiconductor, Inc., Doc. No. AN2731, Rev. 3, Sep. 2015.

(Continued)

*Primary Examiner* — Harshad C Patel
(74) *Attorney, Agent, or Firm* — Knobbe, Martens, Olson & Bear, LLP; Kevin J. Everett

(57) ABSTRACT

Disclosed are ultra-small, planar antennas. The antennas include a circuit board having a first side and a second side and an off-center connector aperture and connector pad; a connector perpendicularly engaging the off-center connector aperture and connector pad of the circuit board; and a radiating element positioned adjacent the off-center connector aperture on a surface of circuit board having a perpendicular connection in plane to the off-center connector pad wherein the radiating element is not positioned below the connector. The ultra-compact, meander line, planar antenna, such as a planar inverted F antenna (PIFA), can be incorporated into wireless networking devices operating in the 2.4 GHz WiFi band. The combination of meander line and antenna elements yield improved performance operating in either free space or connected to a ground plane. Its compact design makes it ideal for WiFi, ZigBee, Bluetooth, and 802.11a/b/g/n/ac applications.

15 Claims, 16 Drawing Sheets

(51) Int. Cl.

| | |
|---|---|
| ***H01Q 13/08*** | (2006.01) |
| ***H01Q 9/06*** | (2006.01) |
| ***H01Q 5/328*** | (2015.01) |
| ***H01Q 1/38*** | (2006.01) |
| ***H01Q 1/36*** | (2006.01) |
| ***H01Q 9/42*** | (2006.01) |

(52) U.S. Cl.
CPC ..... *H01Q 1/38* (2013.01); *H01Q 5/328* (2015.01); *H01Q 9/065* (2013.01); *H01Q 9/42* (2013.01); *H01Q 13/08* (2013.01)

(58) Field of Classification Search
USPC ..... 343/700 MS
See application file for complete search history.

(56) References Cited

U.S. PATENT DOCUMENTS

| | | | | |
|---|---|---|---|---|
| 6,160,522 | A * | 12/2000 | Sanford | H01Q 1/38 343/700 MS |
| 6,738,023 | B2 | 5/2004 | Scott et al. | |
| D515,075 | S | 2/2006 | Kusanagi et al. | |
| 7,215,288 | B2 | 5/2007 | Park et al. | |
| 7,310,068 | B2 * | 12/2007 | Hu | H01Q 1/125 343/702 |
| 8,610,635 | B2 | 12/2013 | Huang et al. | |
| 8,947,319 | B2 * | 2/2015 | Simmons | H01Q 1/007 174/68.1 |
| D754,640 | S | 4/2016 | Zuniga et al. | |
| 2003/0025637 | A1 | 2/2003 | Mendolia et al. | |
| 2004/0051673 | A1 | 3/2004 | Moren et al. | |
| 2009/0207086 | A1 * | 8/2009 | Shinkawa | H01Q 1/1271 343/793 |
| 2010/0019976 | A1 * | 1/2010 | Sakiyama | H01Q 9/0442 343/700 MS |
| 2012/0139811 | A1 * | 6/2012 | Singh | H01Q 1/2216 343/850 |
| 2012/0293279 | A1 * | 11/2012 | Gong | H01P 1/208 333/202 |
| 2012/0299795 | A1 * | 11/2012 | Wang | H01Q 1/241 343/850 |
| 2013/0335280 | A1 | 12/2013 | Chen, III et al. | |
| 2015/0354823 | A1 * | 12/2015 | Koizumi | F23R 3/286 60/737 |

OTHER PUBLICATIONS

Bhuiyan "A double Meander PIFA with a Parasitic Metal Box for Wideband 4G Mobile Phones" (2011).

Chan et al. "Dual-Band Printed Inverted-F Antenna for DCS, 2.4GHz WLAN applications" (Mar. 18, 2008).

Cho et al. "A Design of the Multi-Band chip antenna using meander line PIFA structure for Mobile Phone Handset" (2008).

Choi et al. "Design and SAR Analysis of Broadband PIFA with Tripple Band" (Aug. 25, 2005).

Jung et al. "Dual Frequency Meandered PIFA for Bluetooth and WLAN Applications" (2003).

Khan "Design of Planar Inverted-F Antenna" (May 5, 2014).

Liao, et al. "A Compact Planar Multiband Antenna for Integrated Mobile Devices" (Oct. 1, 2010).

Verma, et al. "A Novel Quad Band Compact Meandered PIFA Antenna for GPS, UMTS, WiMAX, HiperLAN/2 Applications" (2015).

Yang "Ultra-small Antennas and low power receiver for smart dust wireless sensor networks" (2009).

* cited by examiner

ULTRA-SMALL PLANAR ANTENNAS

CROSS-REFERENCE

This application claims the benefit of U.S. Provisional Application No. 62/393,273, filed Sep. 12, 2016, entitled Ultra-small Antennas, which application is incorporated herein by reference.

BACKGROUND

Each successive generation of communication devices is driven by the need for smaller size, greater efficiency, and lower cost. Various types of antennas have been developed to meet these and other increasingly stringent requirements. These include planar inverted F antennas, patch antennas, meander line antennas, and antennas that are combinations of these types.

A wireless LAN (local area network) is one in which an electronic device can connect to other devices on the network through a wireless (radio) connection. WiFi is a local area wireless networking technology that provides two-way communications functionality for devices on the network. Wireless LANs have become popular not only in the office and home but also for mobile communications devices.

One of the frequency bands for WiFi operation is the 2.4 GHz band. For devices operating in this band, there is a particular need for antenna design that is compact, radiates efficiently in free space or connected to a ground plane, and whose impedance matching can be controlled without the need for extraneous matching components.

SUMMARY

Disclosed is a compact, meander line, planar inverted F antenna which is incorporatable into wireless networking devices operating in the 2.4 GHz WiFi band. The antenna has omni-directional gain across the 2.4 GHz band which ensures constant reception and transmission and which, combined with its compact size, makes it an ideal terminal antenna for WiFi, ZigBee, Bluetooth, and 802.11a/b/g/n/ac applications. The design controls impedance matching without actively controlling the impedance matching by virtue of the fact that the planar inverted F antenna (PIFA) structure has a high degree of resistance to impedance matching.

The antenna is planar and consists of a meander line element combined with a PIFA and a connector soldering pad—all contained in a compact, low-profile, small footprint form factor.

In one embodiment, the antenna is designed to radiate efficiently in free space—physically not connected to the ground plane.

In another embodiment, the antenna is directly connected to the ground plane of the device PCB or external metal housing via a short trace. Such an embodiment yields increases in efficiency and gain of the antenna. The embodiments address an ever increasing demand for higher order multiple-input and multiple-output (MIMO) systems in compact form factors that drive the need for ultra-small antennas due to lack of space.

An aspect of the disclosure is directed to ultra-small planar antennas. Suitable antennas comprise: a circuit board comprising first major surface and a second major surface opposite the first major surface; the circuit board defining a connector aperture for a signal feed line, the connector aperture extending between the first major surface and the second major surface, the connector aperture being offset from a center of the circuit board towards a first near edge of the circuit board; a patch element formed on the first major surface and extending at least between the connector aperture and the first near edge; at least one ground connector element formed on the second major surface in register with the patch element; at least one via connecting the patch element to the at least one ground connector element; a coaxial connector comprising a signal feed line and a connector collar, the connector collar co-facing the second major surface and being fixed to the at least one ground connector and the signal feed line extending through the connector aperture and being electrically connected to a connector pad on the first major surface; a radiating element formed on the first major surface and comprising a meander line trace having a meander line portion connected at a first position to the connector pad, the radiating element extending laterally with respect to the coaxial connector away from the near edge of the circuit board so that the meander line trace may radiate in free space. Additionally, the radiator element can be configurable to operate in a 2.4 GHz WiFi band. The circuit board can be configured to be generally oblong, the first near edge comprising a short edge. Additionally, the circuit board is less than approximately 40 mm in length and less than approximately 30 mm in width. In some configurations, he patch element is configurable to substantially surround the connector aperture in a direction between the aperture and the first short edge and first and second longer edges of the circuit board. A plurality of vias can be provided for connecting the patch element to the ground connector. The vias can be distributed in U-shaped pattern around the connector pad. At least one ground connector element comprises a plurality of rectangular pads, each in register with one or more of the plurality of vias. Additionally, configurations can include a dielectric of the circuit board substrate, a gap between the connector pad and the patch element and a thickness of the connector pad extending to the first position are chosen to match the impedance of the antenna with a transceiver circuit. In at least some configurations, the circuit board is encapsulated in a suitable dieletric material. Additionally, the coaxial connector is any one of a SubMiniature A connector (SMA), a micro-miniature coaxial connector (MMCX) or micro coaxial (MCX) male connector. Other connectors can be used without departing from the scope of the disclosure. The connector collar can be solder fixed to the ground connector. The signal feed line can also be soldered to the connector pad. Additionally, the antenna can be, for example, a planar inverted F antenna (PIFA) and wherein the meander line portion is connected at a second location to the patch element. In other configurations, the antenna comprises one of a meandered monopole or dipole structure. Additionally, the circuit board can comprise a printed circuit board.

Another aspect of the disclosure is directed to antennas comprising: a circuit board having a first side and a second side and an off-center connector aperture and connector pad; a connector perpendicularly engaging the off-center connector aperture and connector pad of the circuit board; a ground element positioned on a surface of the circuit board; and a radiating element positioned adjacent the off-center connector aperture on a surface of circuit board having a perpendicular connection in plane to the off-center connector pad wherein the radiating element is not positioned below the connector. The antennas are configurable to have an area in a first dimensional plane of less than 500 $mm^2$, more preferably less than 400 $mm^2$, even more preferably less than 300 $mm^2$, still more preferably less than 200 $mm^2$. In some configurations, the antenna has a length less than 25 mm along the axis of the connector. Additionally, the circuit board is configurable to have a width less than 18 mm and a height less than 20 mm. Additionally, the connector is configurable to engages the circuit board through an aperture in a housing. The housing can have a plurality of shapes including, but not limited to rectangular, square, triangular, ovoid, or circular in one planar dimension. Additionally, the housing is formed by encapsulating the circuit board in a dielectric material. Additionally, the antennas are configured so that impedance matching is controllable without active control.

Still another aspect of the disclosure is directed to antennas comprising: a circuit board having a first side and a second side and an off-center connector aperture and connector pad; a connector perpendicularly engaging the off-center connector aperture and connector pad of the circuit board; and a radiating element positioned adjacent the off-center connector aperture on a surface of circuit board having a perpendicular connection in plane to the off-center connector pad wherein the radiating element is not positioned below the connector. The antenna can be configurable to be in communication with a ground element. The ground element can be positioned on a surface of the circuit board. The antennas are configurable to have an area in a first dimensional plane of less than 500 $mm^2$, more preferably less than 400 $mm^2$, even more preferably less than 300 $mm^2$, still more preferably less than 200 $mm^2$. In some configurations, the antenna has a length less than 25 mm along the axis of the connector. Additionally, the circuit board is configurable to have a width less than 18 mm and a height less than 20 mm. Additionally, the connector is configurable to engages the circuit board through an aperture in a housing. The housing can have a plurality of shapes including, but not limited to rectangular, square, triangular, ovoid, or circular in one planar dimension. Additionally, the housing is formed by encapsulating the circuit board in a dielectric material. Additionally, the antennas are configured so that impedance matching is controllable without active control.

Yet another aspect of the disclosure is directed to a planar inverted F antenna comprising: a first side and a second side; a radiating element positioned on the first side comprising a meander line trace having a meander line portion connected at a first positon to a connector pad and connected at a second location to a patch element; a connector pad with a central aperture which connects to an antenna element on the second side; and a rectangular soldering pad that connects the antenna to external electronics positioned on the second side, wherein impedance matching is controllable without active control. In some configurations, the first side and the second side are rectangular in shape and each comprise a first side, a second side, a third side and a forth side wherein each pair of sides is situated at substantially 90 degrees angles to each other. Additionally, the soldering pad on the second side can have a rectangular shape. In some configurations, the connector pad is centrally located in the soldering pad and has a central aperture to facilitate connection to an antenna element on the bottom surface. The planar inverted F antenna is also configurable to radiate efficiently in free space and does not connect to a ground section. A ground section can be positioned on the first side of the planar inverted F antenna. The planar inverted F antenna can be directly connected to a ground section of a PCB of an electronic device via a short trace element. The antenna can be configured to exhibit an omni-directional gain across a 2.4 GHz band. Additionally, the meander element comprises 10 meander portions which meander back and forth across the first side of the planar inverted F antenna. The meander element may also have a first meander portion located adjacent and parallel to one of the sides of the planar inverted F antenna running along its entire length which meets a second meander portion at a corner formed by two sides of the planar inverted F antenna. The second meander portion is configurable to turns at a right angle relative to the first meander portion and parallel to the second side of planar inverted F antenna and meets a third meander portion at the right angle. The third meander portion is configurable to extend from the second meander portion and runs parallel to the first meander portion and engages a fourth meander portion at a substantially right angle. The fourth meander portion is configurable to meet a fifth meander portion at substantially right angle. The fifth meander portion is configurable to runs parallel to the first meander portion and the third meander portion and meets a sixth meander portion at a substantially right angle. The sixth meander portion is is configurable to be parallel to the meander second portion and the fourth meander portion and meets a seventh meander portion at a substantially right angle. The seventh meander portion is configurable to be parallel to the first meander portion, the third meander portion and runs to a point midway between the two sides of the bottom surface of the planar inverted F antenna where it meets an eighth meander portion. The eighth meander portion is configurable to run parallel to two sides of the planar inverted F antenna and terminates at the connector pad. The ninth meander portion is configurable to emanate from the eighth meander portion at a substantially right angle and meets a tenth meander portion at a substantially right angle. The tenth meander portion is configurable to run alongside of one of the sides of the planar inverted F antenna and connects to the patch element. Additionally, the second meander portion is configurable to have a length of approximately 19% of the length of the first meander portion; and the fifth meander portion is configurable to have a length of approximately ⅔ of the individual length of the first meander portion. The patch element can be shaped like a rectangle with a long side corresponding to the both short sides of the bottom surface of planar inverted F antenna and with a U-shaped slot on the one side and identically-sized rectangular notches at the corners formed by the four sides of the bottom surface of planar inverted F antenna.

INCORPORATION BY REFERENCE

All publications, patents, and patent applications mentioned in this specification are herein incorporated by reference to the same extent as if each individual publication, patent, or patent application was specifically and individually indicated to be incorporated by reference. References include, for example:

U.S. D515,075 S issued Feb. 14, 2006 to Kusanagi et al. for Antenna element;

U.S. D754,640 S issued Apr. 26, 2016, to Zuniga et al. for GPS Patch Antenna;

US 2003/0025637 A1 published Feb. 6, 2003 to Mendolia et al. for Miniaturized reverse-fed planar inverted F antenna;

US 2004/0051673 A1 published Mar. 18, 2004 to Moren et al. for Antenna arrangement;

US 2013/0335280 A1 published Dec. 19, 2013 to Chen et al. for Multimode antenna structures and methods thereof;

U.S. Pat. No. 6,738,023 B2 published May 18, 2004 to Scott et al. for Multiband antenna having reverse-fed PIFA;

U.S. Pat. No. 7,215,288 B2 published May 8, 2007 to Park et al. for Electromagnetically coupled small broadband antenna;

U.S. Pat. No. 8,610,635 B2 published Dec. 17, 2013 to Huang et al. for Balanced metamaterial antenna device;

WO 1996/27219 A1 published Sep. 6, 1996 to Lai et al. for Meandering inverted-F antenna;

Compact Integrated Antennas," Freescale Semiconductors (September 2015);

BHUIYAN "A double Meander PIFA with a Parasitic Metal Box for Wideband 4G Mobile Phones" (2011);

CHAN et al. "Dual-Band Printed Inverted-F Antenna for DCS, 2.4 GHz WLAN applications" (Mar. 18, 2008);

CHO et al. "A Design of the Multi-Band chip antenna using meander line PIFA structure for Mobile Phone Handset" (2008);

CHOI et al. "Design and SAR Analysis of Broadband PIFA with Tripple Band" (Aug. 25, 2005);

JUNG et al. "Dual Frequency Meandered PIFA for Bluetooth and WLAN Applications" (2003);

KHAN "Design of Planar Inverted-F Antenna" (May 5, 2014);

LIAO, et al. "A Compact Planar Multiband Antenna for Integrated Mobile Devices" (Oct. 1, 2010);

VERMA, et al. "A Novel Quad Band Compact Meandered PIFA Antenna for GPS, UMTS, WiMAX, HiperLAN/2 Applications" (2015); and YANG "Ultra-small Antennas and low power receiver for smart dust wireless sensor networks" (2009).

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

Figure 1B:
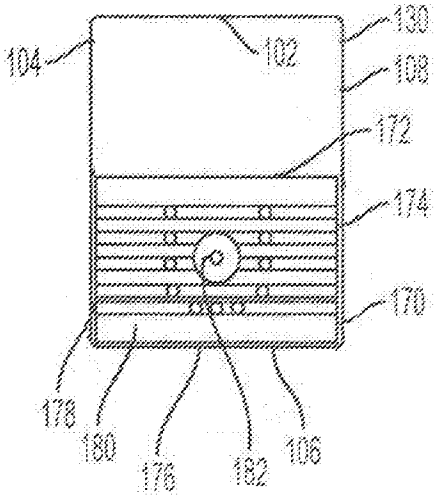
FIG. 1B presents a top view of the antenna according to the disclosure.
Figure 1A:
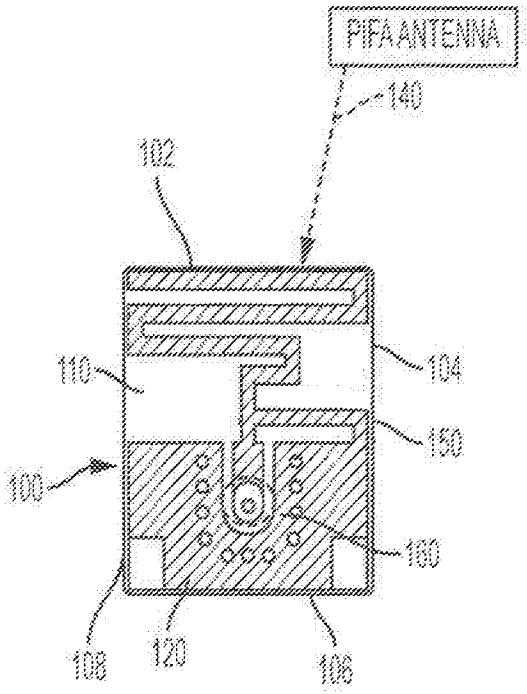
FIG. 1A presents a bottom view of the antenna according to the disclosure.

FIGS. 1A-B illustrate a bottom view and a top view of a suitable external terminal WiFi 2.4 GHz planar inverted F antenna (PIFA). FIG. 1A is a bottom view of the antenna 100 having a bottom surface 110. The antenna 100 is planar, of substantially uniform thickness, and, as illustrated, has a first side 102, a second side 104, a third side 106 and a fourth side 108, numbered clockwise as illustrated. The sides are situated substantially at 90 degree angles so that the resulting surface forms a rectangle where sides 104 and 108 are the longer sides and sides 102 and 106 are the shorter sides, respectively. In the embodiment illustrated, the longer sides 104 and 108 are approximately 21.5% longer than the shorter sides 102 and 106. The ground 120 is positioned on the bottom surface and is described and illustrated in further detail in FIG. 2. A PIFA antenna trace 140 connects to a short antenna trace element 150. A signal feed soldering pad 160 is also provided which has a soldering pad 170 for the connector on the opposite side as shown in FIG. 1B. As will be appreciated by those skilled in the art, other antenna configurations can be used without departing from the scope of the disclosure. For example, instead of a PIFA, the radiating element could comprise either a monopole or dipole structure.

FIG. 1B illustrates a top view of the antenna 100 with a top surface 130. The top surface 130 has a first side 102, a second side 104, a third side 106 and a fourth side 108, corresponding to the first side 102, a second side 104, a third side 106 and a fourth side 108 of the bottom surface 110 shown in FIG. 1A. The plan form of the top surface 130 corresponds in shape and dimension to that of the bottom surface described in FIG. 1A. A soldering pad 170 is positioned upon the top surface 130 which provides a soldered connection to external electronics. The soldering pad 170 is rectangular in shape and has a first side 172, a second side 174, a third side 176 and a fourth side 178, as illustrated. Third side 176 of the soldering pad 170 is co-located with fourth side 108 of the top surface 130 and runs along the entirety of the fourth side 108 of the top surface 130. Second side 174 and fourth side 178 are co-located with third side 106 and second side 104 of the top surface 130 and are approximately 51.9% as long as the entire third side 106 or second side 104. First side 172 of the soldering pad 170 completes the rectangular shape of the soldering pad 170, running parallel to first side 102 and fourth side 108 of the top surface 130. Connector pad 180 is centrally located in the soldering pad 170. The connector pad 180 has a central aperture 182 which is used to facilitate connection to the antenna element on the bottom surface 110.

In the illustrated embodiments, a printed circuit board (PCB) can be used. The PCB can comprise an FR-4 PCB on which the various traces are defined, whereas in alternative implementations the trace could be created by stamping a metal part and insert molding the stamped metal part into a circuit board.

Figure 2:
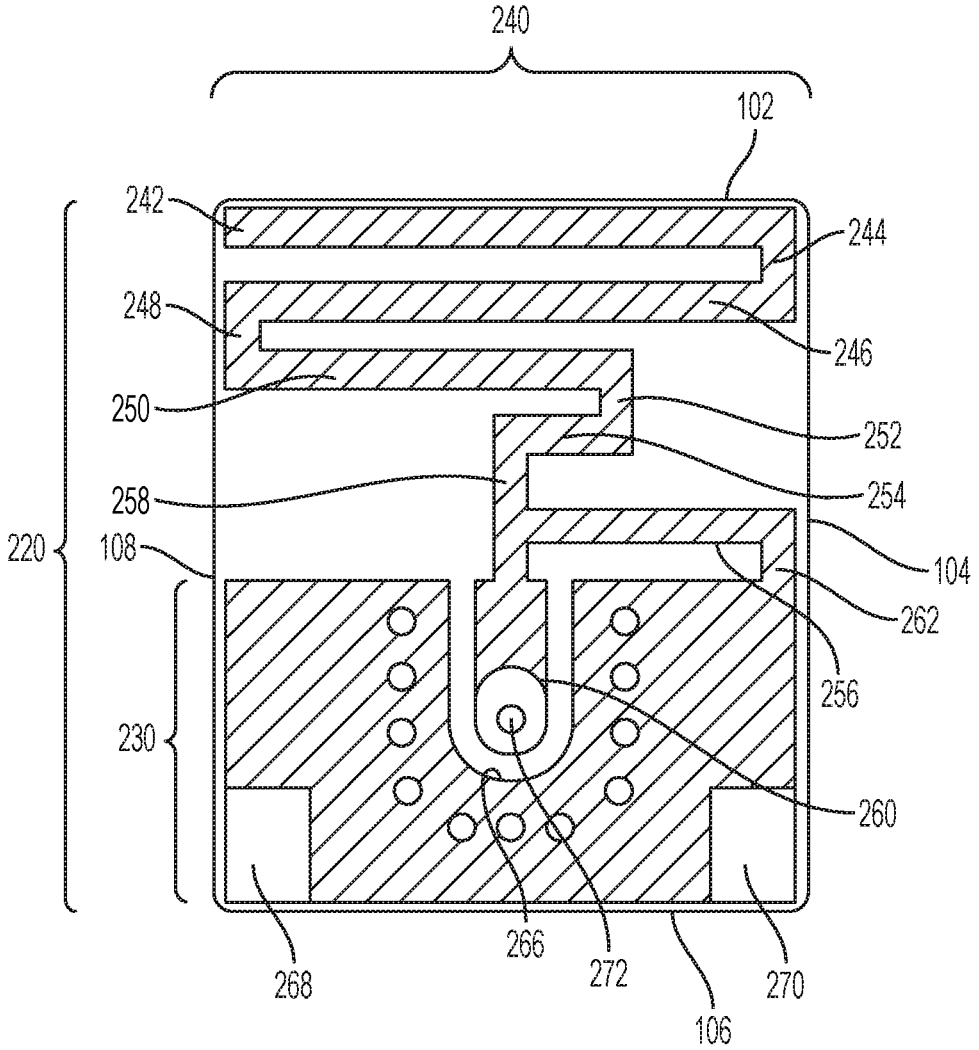
FIG. 2 presents a detail view of the meander trace element and PIFA shown in FIG. 1A.

FIG. 2 illustrates the detail of the radiating element 220 of the antenna 100 located on the bottom surface 110. The radiating element 220 comprises a patch element 230 combined with a meander line element 240 and a connector pad 260 with a central aperture 272 located opposite the connector pad 180 described in FIG. 1B. The meander line element 240 consists of several portions which meander back and forth across the bottom surface 110. A first meander line portion 242 is located adjacent and parallel to first side 102 of the bottom surface 110, running along substantially the entire length of the entire length of the first side 102. The first meander line portion 242 meets a second meander line portion 244 at the corner formed by sides 102 and 104 of the bottom surface 110. The second meander line portion 244 extends from the first meander line portion 242 at a right angle and runs alongside second side 104 of the bottom surface 110. The length of the second meander line portion 244 is approximately 19% of the length of the first meander line portion 242. The second meander line portion 244 meets a third meander line portion 246 at a right angle to the second meander line portion 244. The third meander line portion 246 runs parallel, and is of equal length, to the first meander line portion 242. The third meander line portion 246 meets a fourth meander line portion 248 at a substantially right angle. The fourth meander line portion 248 runs alongside fourth side 108 of the bottom surface 110 and is substantially the same length as the second meander line portion 244. The fourth meander line portion 248 meets a fifth meander line portion 250 at a substantially right angle. The fifth meander line portion 250 runs parallel to the first meander line portion 242 and the third meander line portion 246 and is approximately ⅔ the individual length of either of the first meander line portion 242 or the third meander line portion 246. The fifth meander line portion 250 meets a sixth meander line portion 252 at a substantially right angle. The sixth meander line portion 252 is parallel to and the substantially the same length as either the second meander line portion 244 or the fourth meander line portion 248. The sixth meander line portion 252 meets a seventh meander line portion 254 at a substantially right angle. The seventh meander line portion 254 is parallel to each of the first meander line portion 242, the third meander line portion 246 and the fourth meander line portion 248, and runs to a point midway between the second side 104 and the fourth side 108 of the bottom surface 110 where the seventh meander line portion 254 meets an eighth meander line portion 258. The eighth meander line portion 258 runs parallel to the second side 104 and the fourth side 108 of the bottom surface 110 where it terminates at a connector pad 260. A ninth meander line portion 256 emanates from the eighth meander line portion 258 at a substantially right angle. The ninth meander line portion 256 is run to the edge of the bottom surface 110 that is defined by the second side 104 where it meets a tenth meander line portion 262 at a substantially right angle. The tenth meander line portion 262 runs alongside the second side 104 of the bottom surface 110 and connects to a patch element 230. The patch element 230 is shaped like a rectangle with its long side corresponding to the short sides, first side 102 and third side 106 of the bottom surface 110; with a U-shaped slot 266 on one side and identically-sized rectangular notches 268 and 270 at the corners formed by third side 106 and fourth side 108 and third side 106 and second side 104, respectively.

Figure 3A:
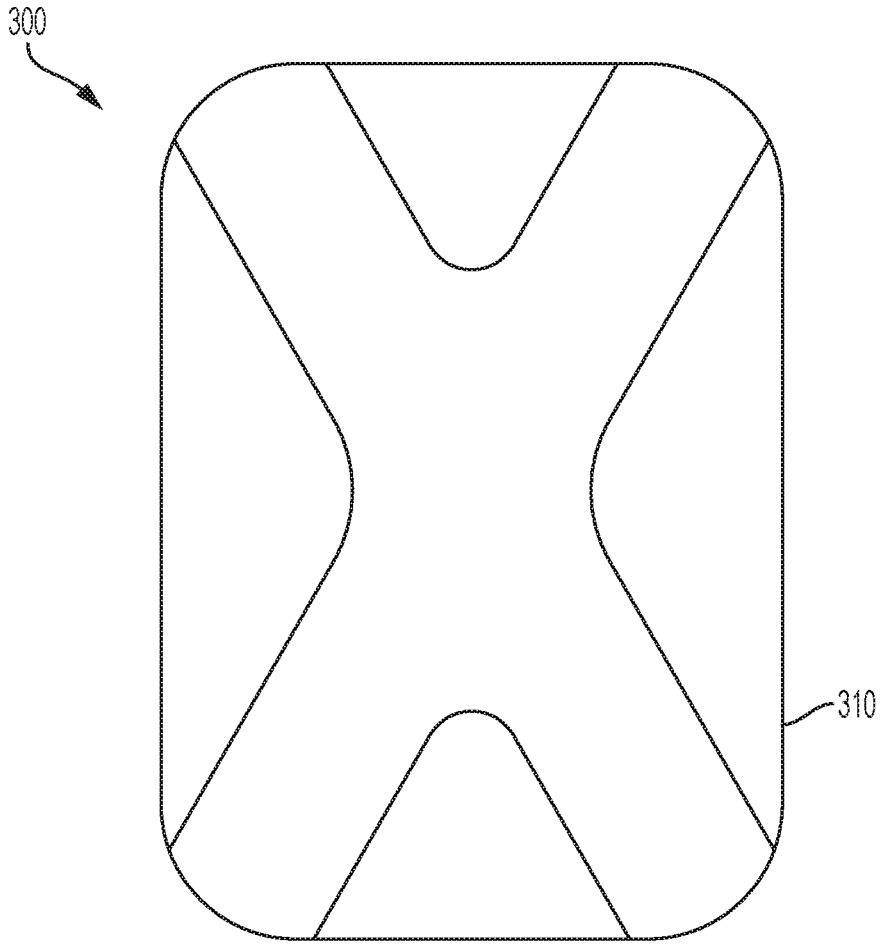
FIGS. 3A-C illustrate an antenna positioned within a housing.
Figure 3B:
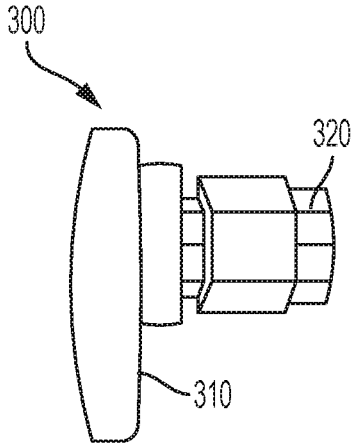
Figure 3C:
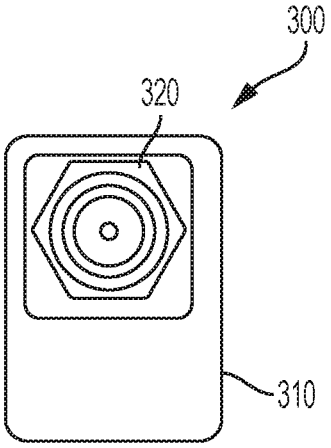

FIGS. 3A-C illustrate an antenna device 300 with a housing 310. The housing protects the antenna electronics from damage and can provide a connector 320 such as a Subminiature version A (SMA) connector, micro-miniature coaxial connectors (MMCX), and micro-coaxial connectors (MCX) connectors. Other connectors can be used without departing from the scope of the disclosure. Suitable connectors include, but are not limited to, SMA(M), MMCX(M), and MCX(M) connectors. The housing 310 shown in FIG. 3A can have dimensions of from 10 mm to 30 mm in the x dimension, more preferably from 13 mm to 16 mm, and even more preferable 13.7 mm to 14.9 mm, and from 13 mm to 40 mm in the y dimension, more preferably from 15 mm to 30 mm, and even more preferably from 19.2 mm to 20.4 mm. The overall area in two dimensions can be, for example, less than 300 $mm^2$.

The overall height of the antenna device 300, shown along the x axis in FIG. 3B is from 10 mm to 25 mm, more preferably 14 mm to 20 mm, and even more preferably 15.3 mm to 17.5 mm. As will be appreciated by those skilled in the art, from a side perspective view, the housing 310 can have a flat bottom surface that engages the connector 320 and a convex-curved upper surface, as illustrated. Alternatively, the housing can have two parallel flat surfaces, or two curved surface. The curved surface(s) can be convex, as shown, or concave.

Figure 4:
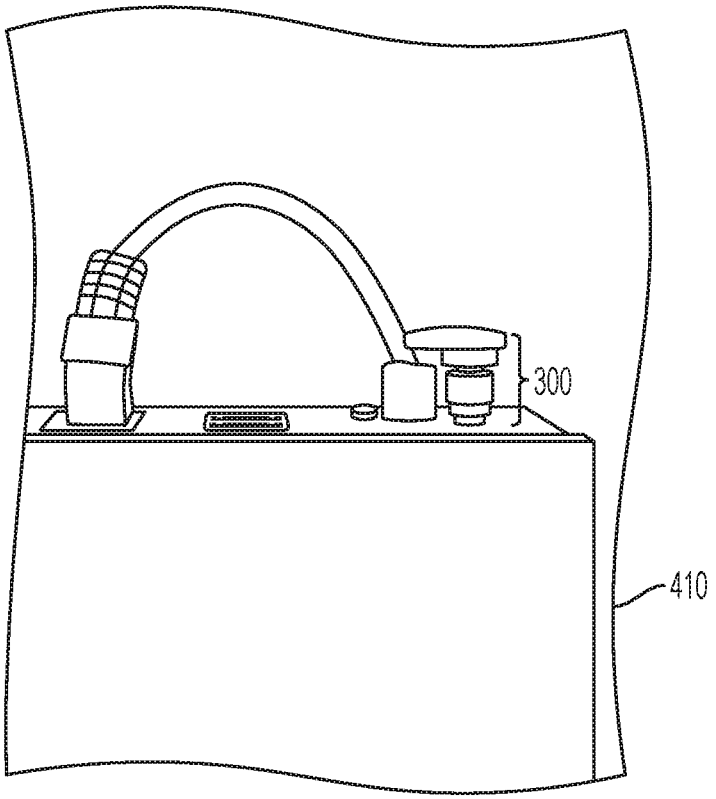
FIG. 4 illustrates an antenna connected to a router.

Using a housing 310 at an angle to a connector 320 allows the antenna to achieve a small mounting footprint (i.e., the antenna is positionable close to the housing of the electronic device it engages, as shown in FIG. 4). An additional benefit of this configuration is that the antenna is structurally more stable than using, for example, a coaxial cable. Positioning the connector 320 off center on the housing 310 allows the transmission lines to be positioned within the housing in a position adjacent to the location where the connector 320 extends from the housing. The result is that the radiating element is over the plane of the connector which allows for good radiation efficiency of the antenna during use. As will be appreciated by those skilled in the art, if the radiating element was positioned, for example, below the connector, the antenna would not radiate well and performance of the antenna would be compromised. The positioning of the radiating element relative to the connector enables the use of a wider variety of meander lines or PIFAs. Offsetting the connector to the radiating elements enables the overall antenna to have a small form factor.

The connector mechanism 320 is positioned at a right angle, or substantially right angle, to the housing 310. The housing 310 can be rectangular with rounded corners in a first dimension with a length and width in the first dimension (shown in FIG. 3A) greater than a thickness (shown in FIG. 3B). Other housing shapes are possible without departing from the scope of the disclosure, including, for example, square, triangular, round, oval, and ovoid. The round, oval, and ovoid shapes can have one or more truncated (i.e., straight ends) that in some configurations result in, for example, a biscuit shape (e.g., where the oval shape has two parallel truncated ends). The housing can be formed by encapsulating the circuit board in a suitable dielectric material or can be a housing formed from a suitable dielectric material which features a cavity in which the antenna, such as antenna 100 shown in FIG. 1A is positioned.

FIG. 4 illustrates an antenna 300 connected to a router 410. As will be appreciated by those skilled in the art, a plurality of antennas can be employed in a given implementation such that a hosting device (such as a router) has a line of low-profile, ultra-small antennas of the kind disclosed. The antennas could be positioned in a line (e.g., 2, 3, 4 . . . n antennas in a row), or in a grid (e.g., 2×2, 3×3, 4×4, n×n).

Figure 5:
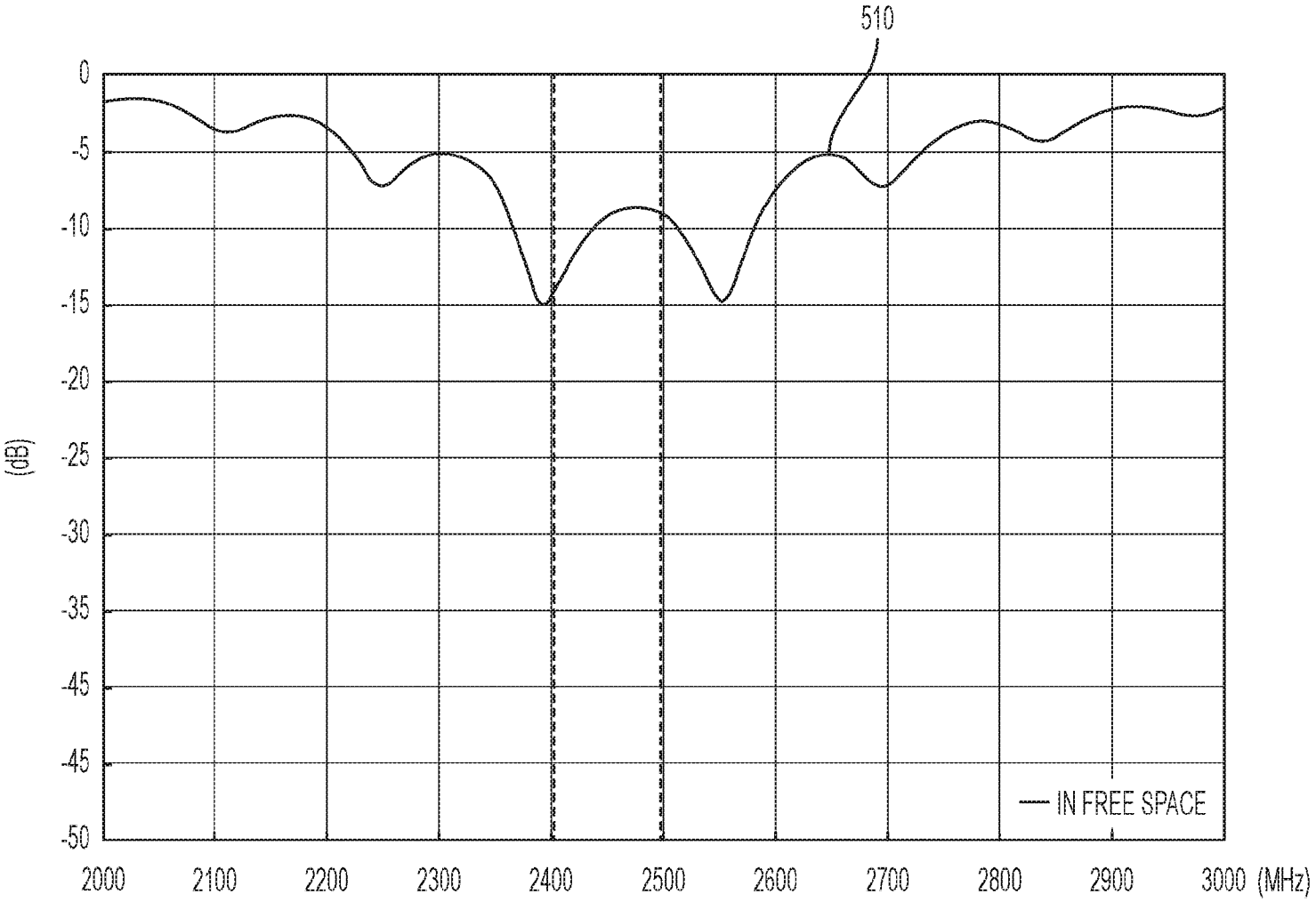
FIG. 5 is a plot of the measured return loss in free space for an antenna according to the disclosure.

FIG. 5 is a graph of the measured return loss in free space 510 for the antenna across the range of frequencies from 2000 MHz to 3000 MHz. Of particular interest for WiFi applications is the range between 2400 MHz and 2500 MHz where the return loss varies from approximately −14 dB at 2400 MHz, rising to a peak of approximately −9 dB at 2480 MHz, then falling slightly to approximately −9.5 dB at 2500 MHz.

Figure 6:
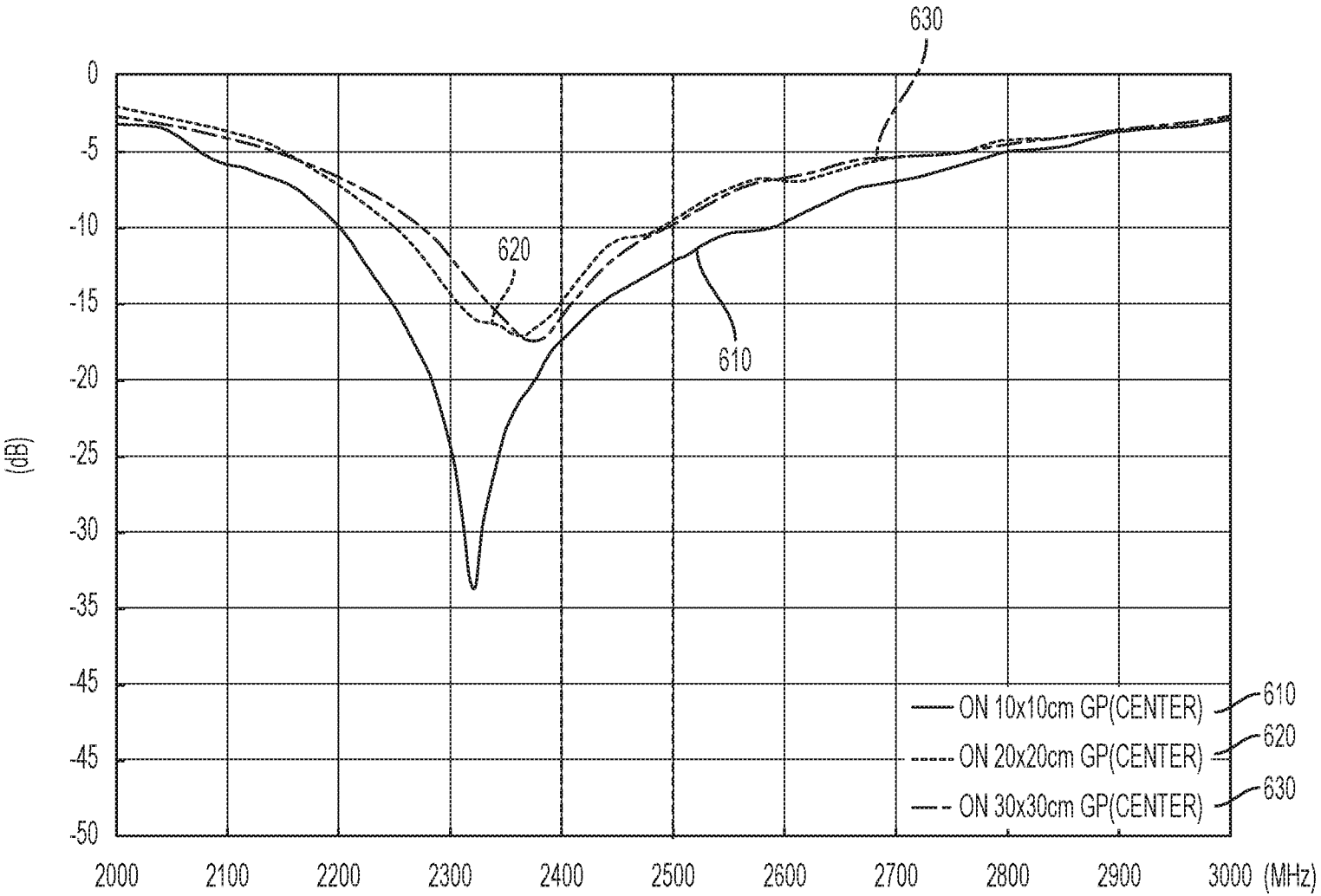
FIG. 6 is a plot of the measured return loss in the center of the ground plane for an antenna according to the disclosure.

FIG. 6 is a graph of the measured return loss at the center of a ground plane for the antenna across the range of frequencies from 2000 MHz to 3000 MHz. Results are plotted for ground planes of 10 cm×10 cm square 610, 20 cm×20 cm square 620, and 30 cm×30 cm square 630. In the range between 2400 MHz and 2500 MHz, the return loss for the 10 cm×10 cm square ground plane is approximately −17 dB at 2400 MHz, and it increases monotonically to approximately −13 dB at 2500 MHz. The return loss for the 20 cm×20 cm square ground plane between 2400 MHz and 2500 MHz is approximately −15 dB at low end of the range, and it increases monotonically to approximately −9 dB at high end of the range. In the range between 2400 MHz and 2500 MHz, the return loss for the 30 cm×30 cm square ground plane is approximately −16 dB at 2400 MHz. It then increases monotonically to approximately −10 dB at 2500 MHz.

Figure 7:
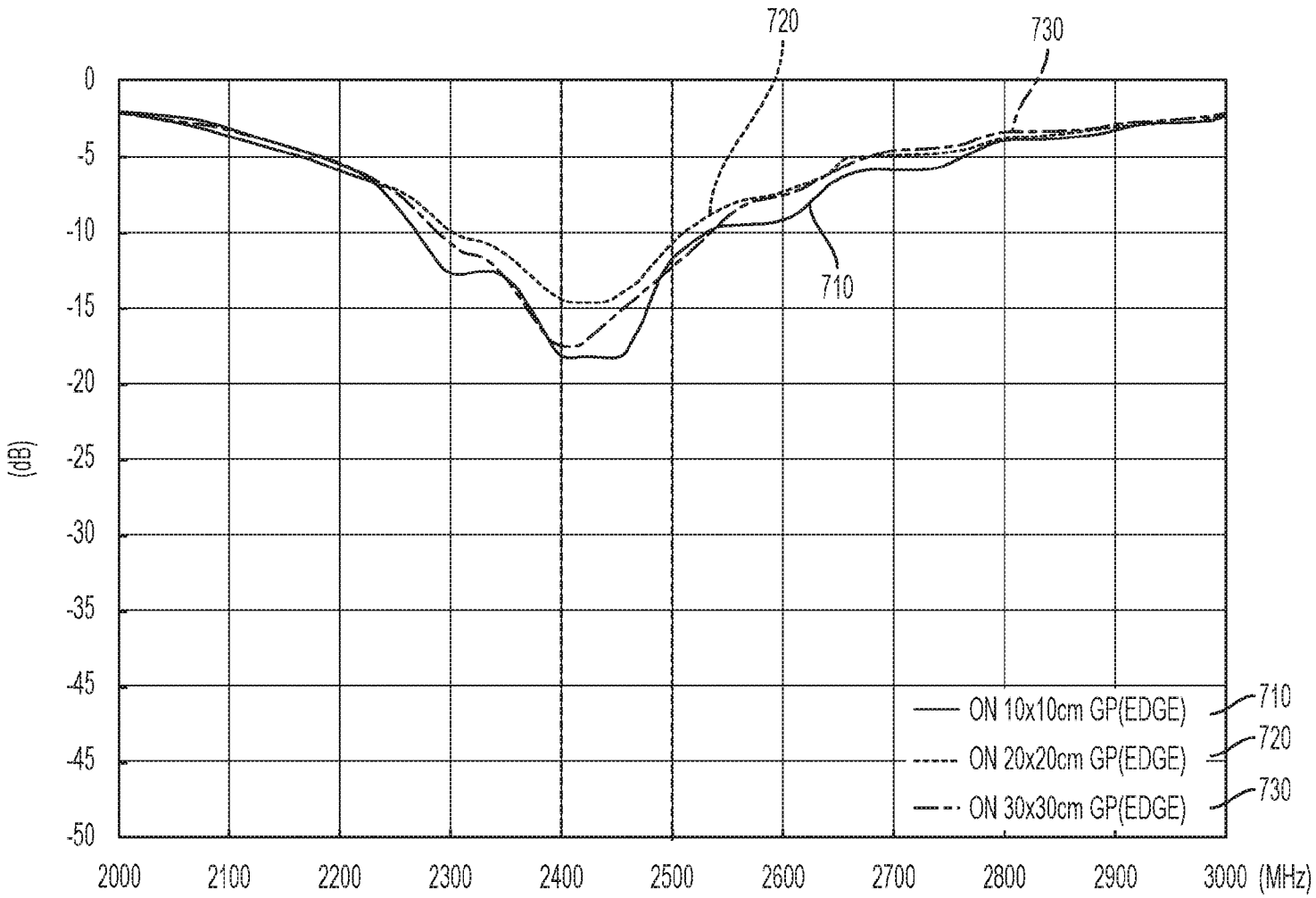
FIG. 7 is a plot of the measured return loss at the edge of the ground plane for an antenna according to the disclosure.

FIG. 7 is a graph of the measured return loss at the edge of a ground plane for the antenna across the range of frequencies from 2000 MHz to 3000 MHz. Results are plotted for ground planes of 10 cm×10 cm square 710, 20 cm×20 cm square 720, and 30 cm×30 cm square 730. In the range between 2400 MHz and 2500 MHz, the return loss for the 10 cm×10 cm square ground plane is approximately −18 dB at 2400 MHz; it remains relatively even to approximately 2460 MHz, then it increases monotonically to approximately −12 dB at 2500 MHz. The return loss for the 20 cm×20 cm square ground plane between 2400 MHz and 2500 MHz is approximately −14.5 dB at low end of the range, decreasing to approximately −15 dB at approximately 2430 MHz, then proceeding monotonically upward to approximately −11 dB at 2500 MHz. The return loss for the 30 cm×30 cm square ground plane is approximately −17 dB at 2400 MHz, remaining relatively flat to approximately 2420 MHz, then increasing monotonically to approximately −12.5 dB at 2500 MHz.

Figure 8:
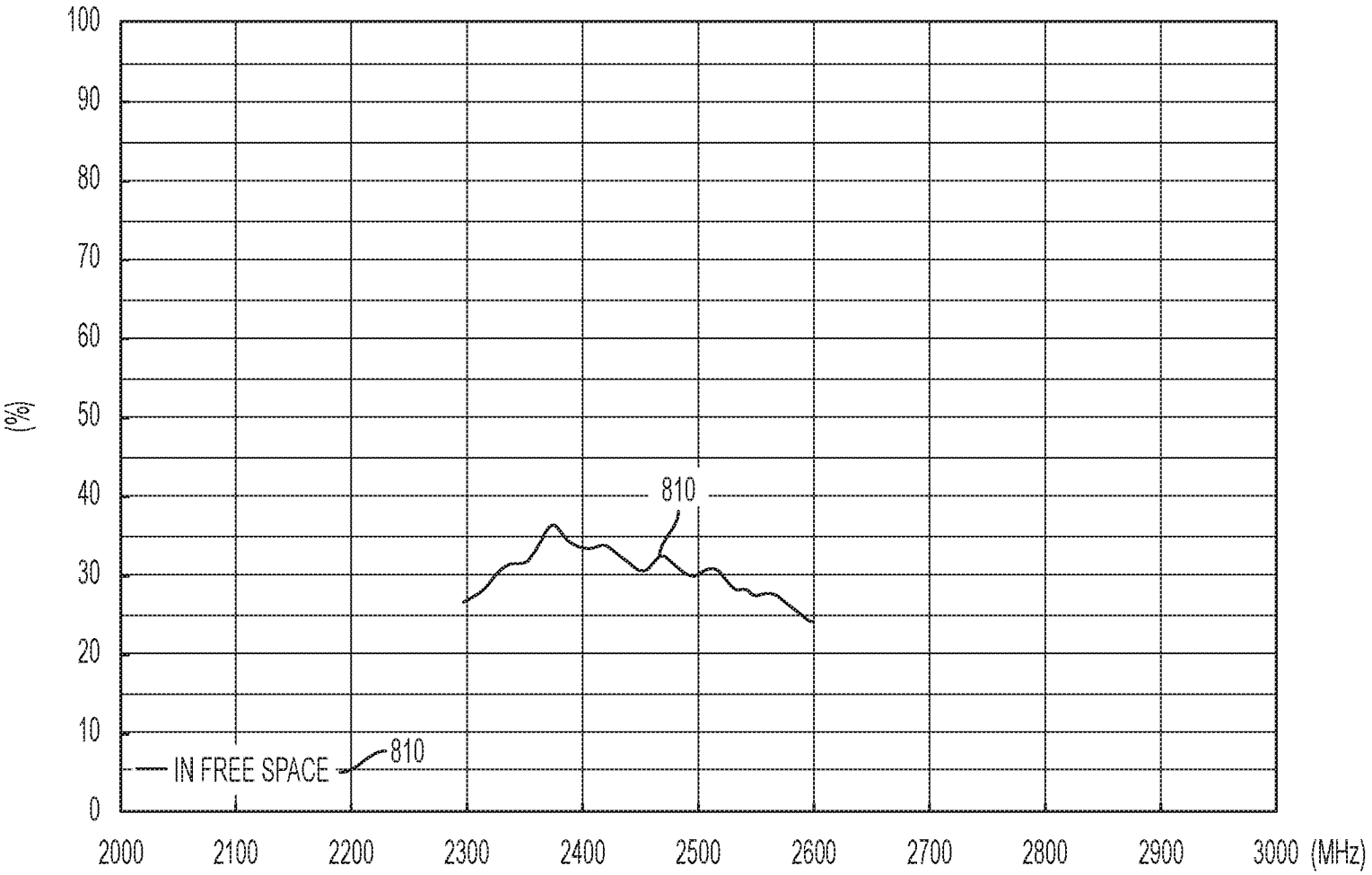
FIG. 8 is a plot of the measured efficiency in free space for an antenna according to the disclosure.

FIG. 8 is plot of the measured efficiency in free space of the antenna in the frequency range between 2300 MHz and 2600 MHz 810. At 2400 MHz, efficiency is approximately 34%. It decreases in sawtooth fashion to approximately 30% at 2500 MHz.

Figure 9:
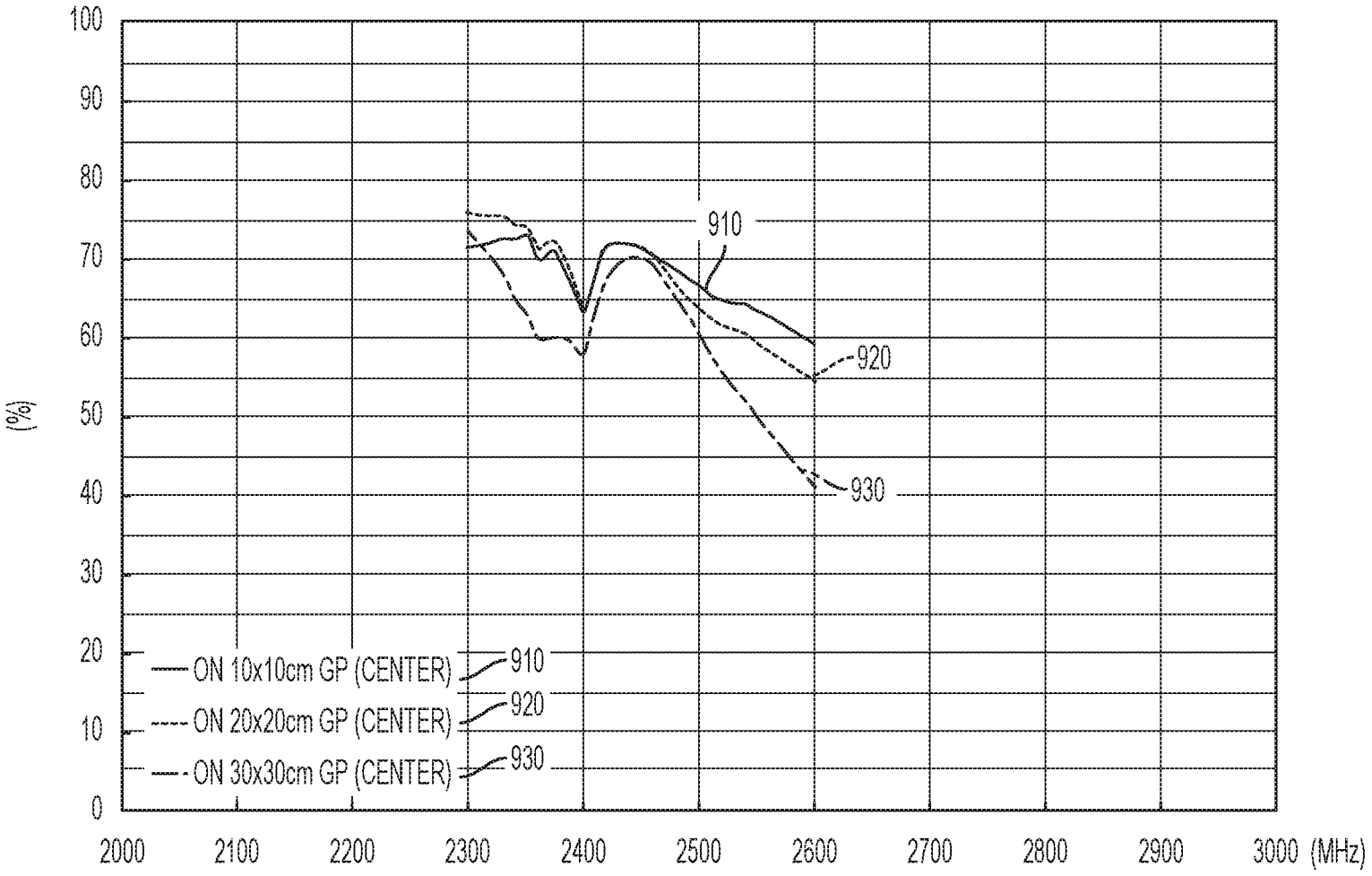
FIG. 9 is a plot of the measured efficiency at the center of the ground plane for an antenna according to the disclosure.

FIG. 9 is a graph of the efficiency of the antenna measured at the center of the ground plane for three different ground planes, measuring 10 cm×10 cm square 910, 20 cm×20 cm square 920, and 30 cm×30 cm square 930. Between 2400 MHz and 2500 MHz, the efficiency curve of the antenna for each of these ground planes is shaped roughly like a concave-down parabola. For the 10 cm×10 cm square ground plane, the efficiency is approximately 64% at 2400 MHz, rising to a local maximum of approximately 72% at approximately 2420 MHz, then decreasing to a value of approximately 60% at 2500 MHz. For the 20 cm×20 cm square ground plane, the efficiency is approximately 65% at 2400 MHz, rising to a local maximum of approximately 72% at 2450 MHz, then decreasing to a value of approximately 64% at 2500 MHz. For the 30 cm×30 cm square ground plane, the efficiency is approximately 58% at 2400 MHz, rising to a local maximum of approximately 70% at 2450 MHz, then decreasing to a value of approximately 60% at 2500 MHz.

Figure 10:
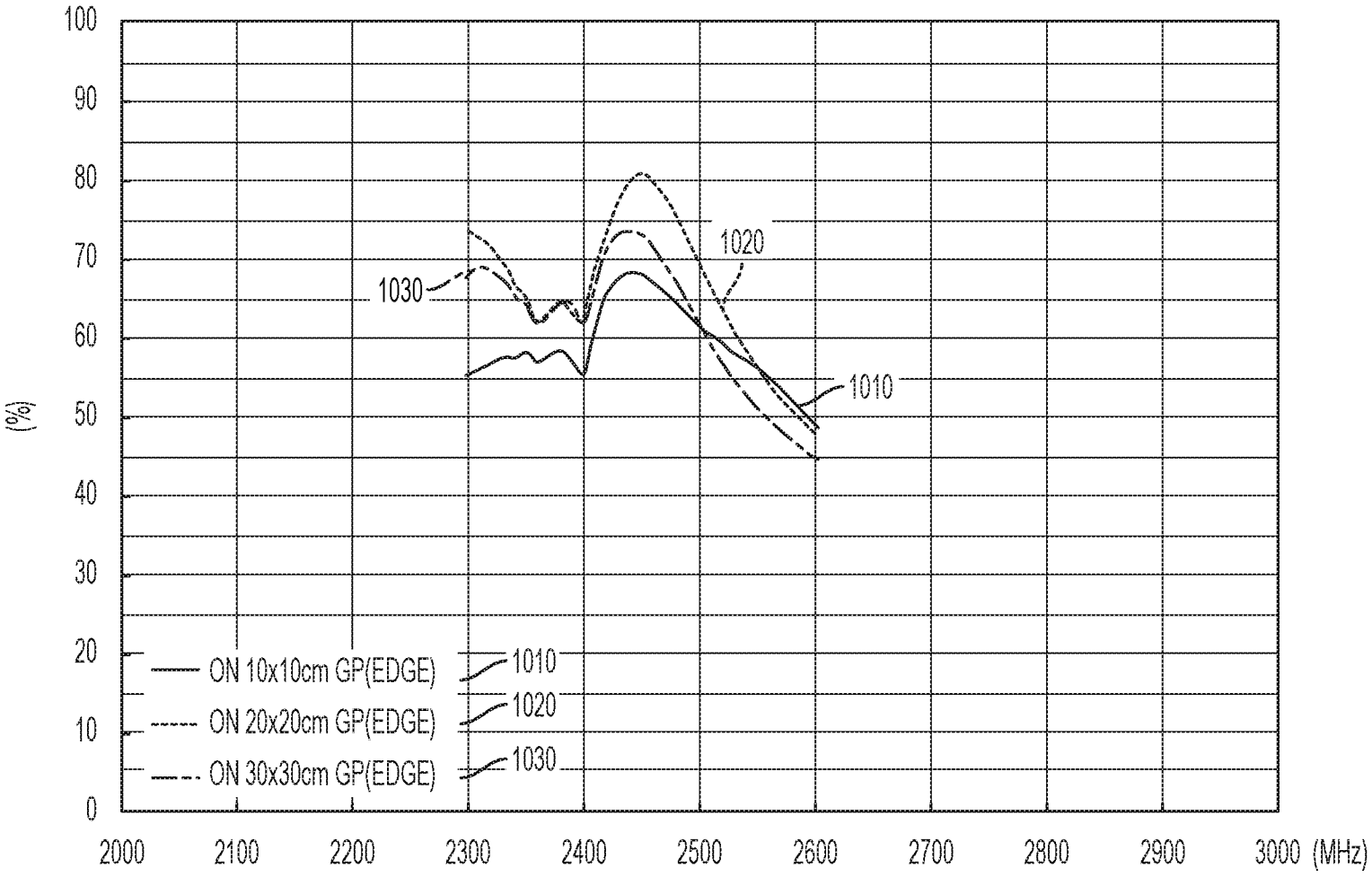
FIG. 10 is a plot of the measured efficiency at the edge of the ground plane for an antenna according to the disclosure.

FIG. 10 is a graph of the efficiency of the antenna measured at the edge of the ground plane for three different ground planes, measuring 10 cm×10 cm square 1010, 20 cm×20 cm square 1020, and 30 cm×30 cm square 1030. Between 2400 MHz and 2500 MHz, the efficiency curve of the antenna for each of these ground planes is shaped roughly like a concave-down parabola. For the 10 cm×10 cm square ground plane, the efficiency is approximately 56% at 2400 MHz, rising to a local maximum of approximately 69% at approximately 2440 MHz, then decreasing to a value of approximately 62% at 2500 MHz. For the 20 cm×20 cm square ground plane, the efficiency is approximately 63% at 2400 MHz, rising to a local maximum of approximately 81% at approximately 2440 MHz, then decreasing to a value of approximately 70% at 2500 MHz. For the 30 cm×30 cm square ground plane, the efficiency is approximately 63% at 2400 MHz, rising to a local maximum of approximately 74% at approximately 2430 MHz, then decreasing to a value of approximately 62% at 2500 MHz.

Figure 11:
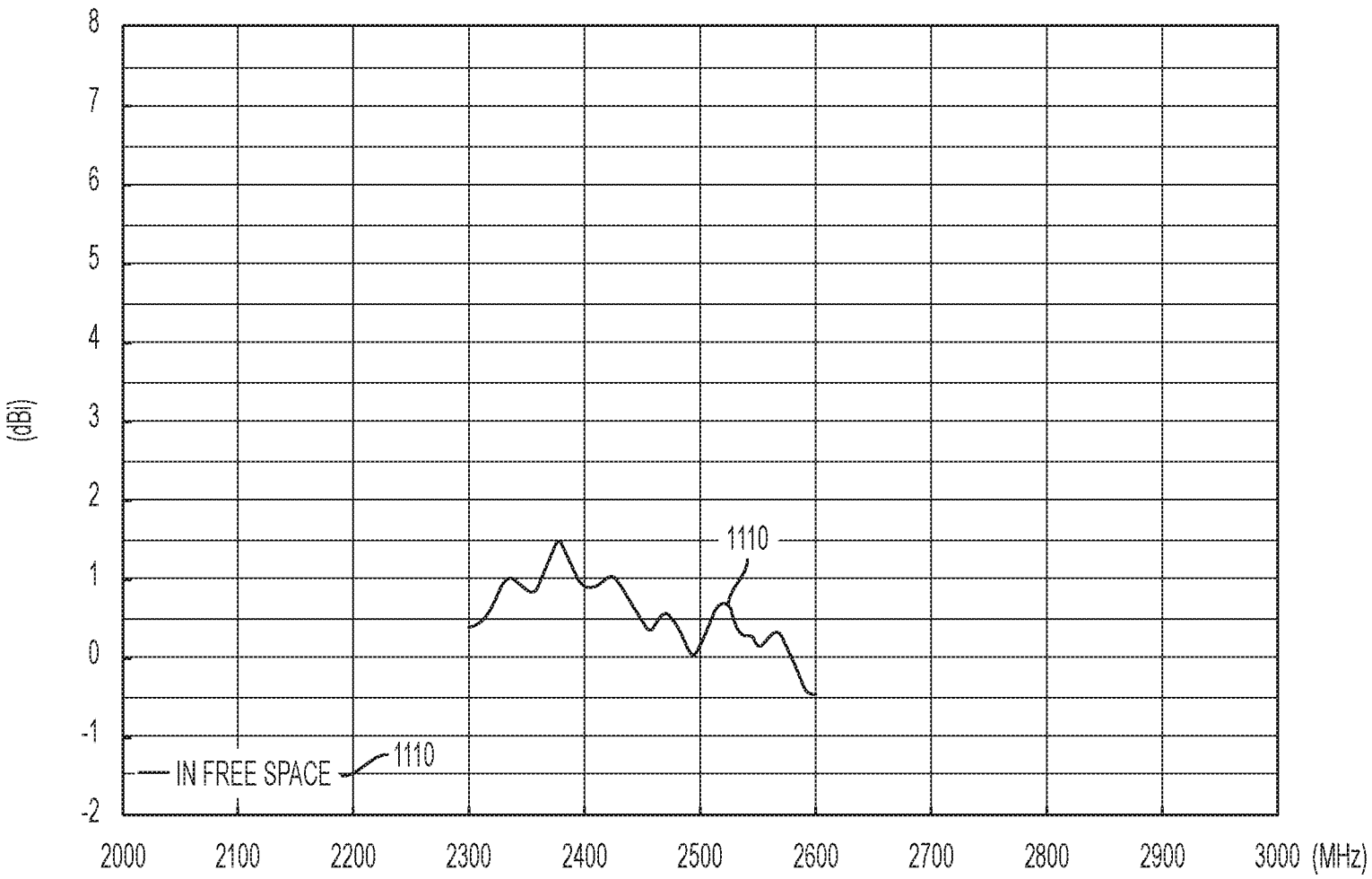
FIG. 11 is a plot of the measured peak gain in free space for an antenna according to the disclosure.

FIG. 11 is a plot of the measured peak gain in free space of the antenna in the frequency range between 2300 MHz and 2600 MHz 1110. At 2400 MHz, peak gain is approximately 0.9 dB. It rises to approximately 1 dB at approximately 2420 MHz, then decreases in sawtooth fashion to approximately 0.1 dB at 2500 MHz.

Figure 12:
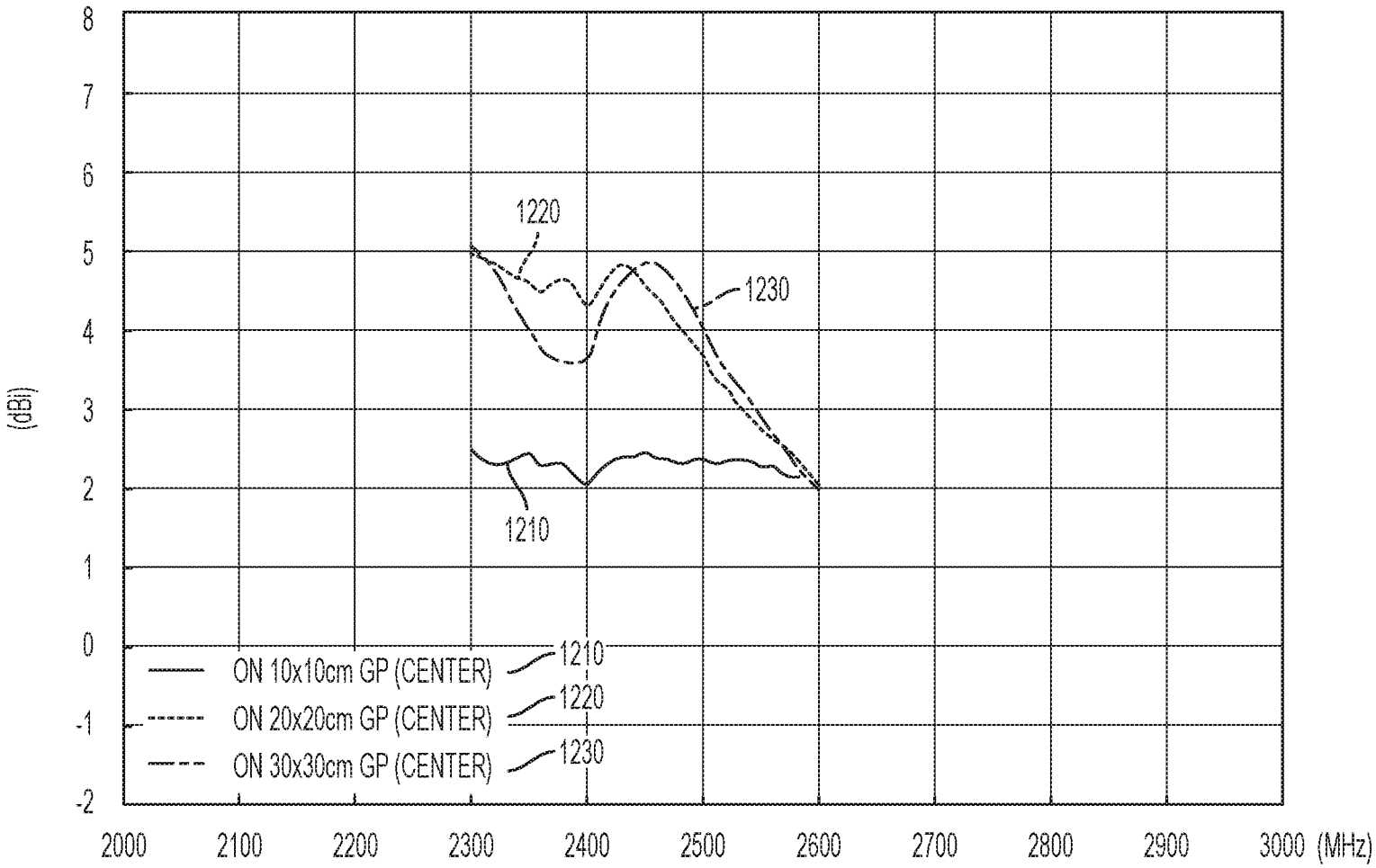
FIG. 12 is a plot of the measured peak gain at the center of the ground plane for an antenna according to the disclosure.

FIG. 12 is a graph of the peak gain of the antenna measured at the center of the ground plane for three different ground planes, measuring 10 cm×10 cm square 1210, 20 cm×20 cm square 1220, and 30 cm×30 cm square 1230, across the frequency range between 2300 MHz and 2600 MHz. Between 2400 MHz and 2500 MHz, peak gain for the 10 cm×10 cm square ground plane is relatively flat, ranging from approximately 2.0 dB at 2400 MHz, rising to a local maximum of approximately 2.4 dB at approximately 2450 MHz, then decreasing to a value of approximately 2.3 dB at 2500 MHz. For the 20 cm×20 cm square ground plane, the peak gain is approximately 4.3 dB at 2400 MHz, rising to a local maximum of approximately 4.8 dB at approximately 2430 MHz, then decreasing to a value of approximately 3.7 dB at 2500 MHz. For the 30 cm×30 cm square ground plane, the peak gain is approximately 3.6 dB at 2400 MHz, rising to a local maximum of approximately 4.8 dB at 2450 MHz, then decreasing to a value of approximately 4.0 dB at 2500 MHz.

Figure 13:
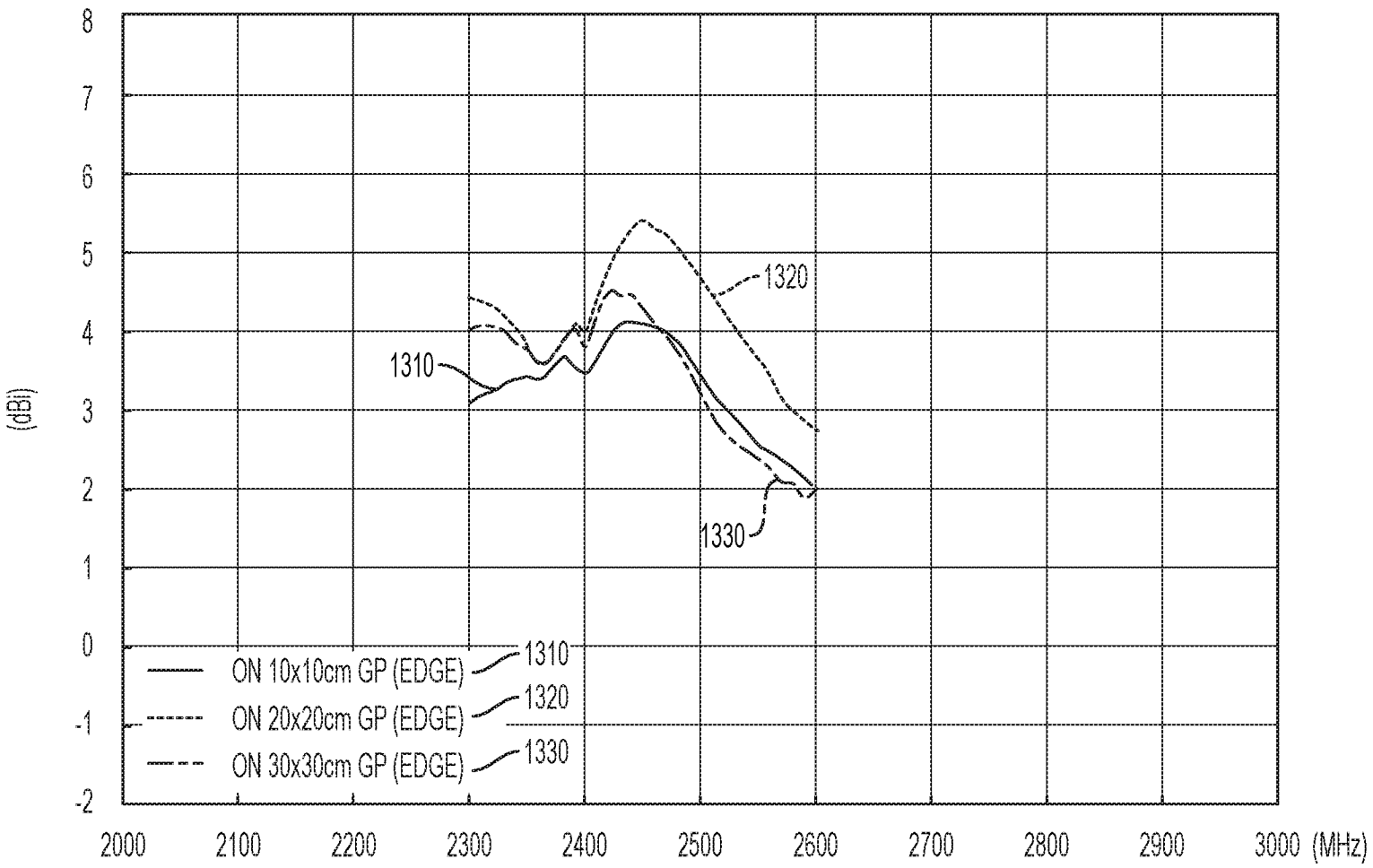
FIG. 13 is a plot of the measured peak gain at the edge of the ground plane for an antenna according to the disclosure.

FIG. 13 is a graph of the peak gain of the antenna measured at the edge of the ground plane for three different ground planes, measuring 10 cm×10 cm square 1310, 20 cm×20 cm square 1320, and 30 cm×30 cm square 1330, across the frequency range between 2300 MHz and 2600 MHz. For the 10 cm×10 cm square ground plane, the peak gain is approximately 3.5 dB at 2400 MHz, rising to a local maximum of approximately 4.1 dB at approximately 2430 MHz, then decreasing monotonically to a value of approximately 3.5 dB at 2500 MHz. For the 20 cm×20 cm square ground plane, the peak gain is approximately 4.0 dB at 2400 MHz, rising to a local maximum of approximately 5.3 dB at approximately 2440 MHz, then decreasing to a value of approximately 4.7 dB at 2500 MHz. For the 30 cm×30 cm square ground plane, the peak gain is approximately 3.8 dB at 2400 MHz, rising to a local maximum of approximately 4.4 dB at approximately 2420 MHz, then decreasing to a value of approximately 3.0 dB at 2500 MHz.

Figure 14:
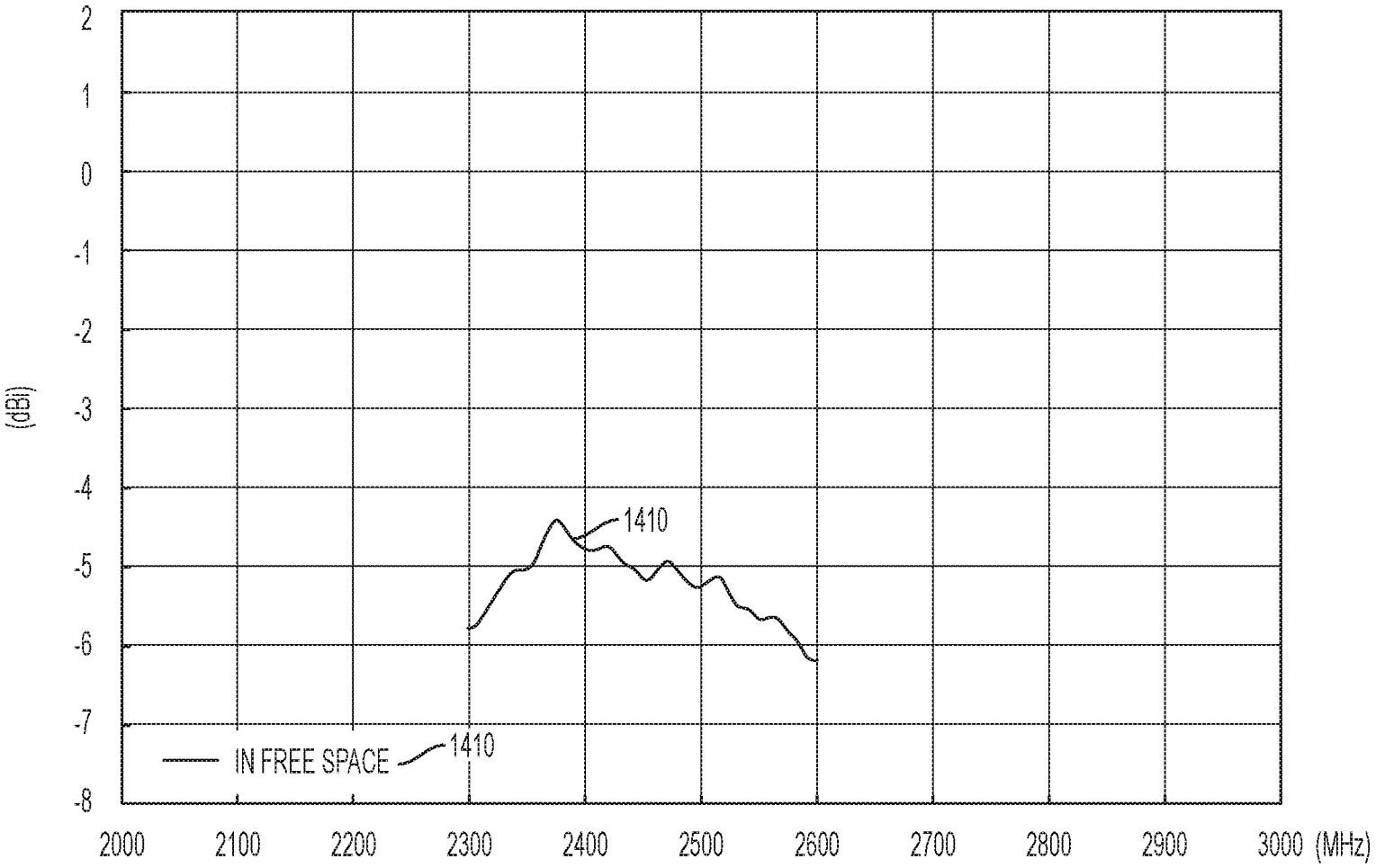
FIG. 14 is a plot of the measured average gain in free space for an antenna according to the disclosure.

FIG. 14 is a plot of the measured average gain in free space of the antenna in the frequency range between 2300 MHz and 2600 MHz 1410. At 2400 MHz, average gain is approximately −4.8 dB. It then decreases in sawtooth fashion to approximately −5.3 dB at 2500 MHz.

Figure 15:
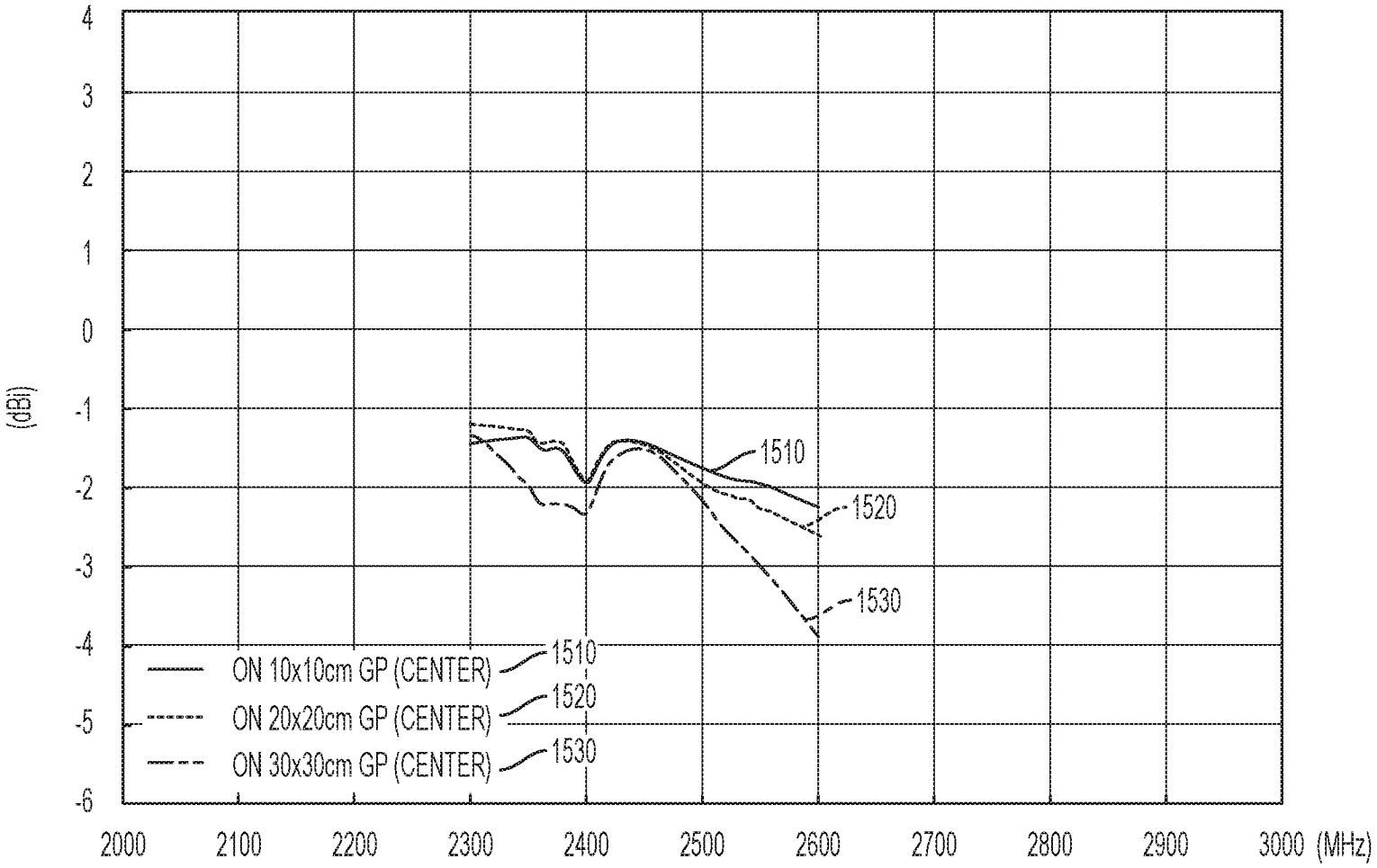
FIG. 15 is a plot of the measured average gain at the center of the ground plane for an antenna according to the disclosure.

FIG. 15 is a graph of the average gain of the antenna measured at the center of the ground plane for three different ground planes, measuring 10 cm×10 cm square 1510, 20 cm×20 cm square 1520, and 30 cm×30 cm square 1530, across the frequency range between 2300 MHz and 2600

MHz. Between 2400 MHz and 2500 MHz, average gain for the 10 cm×10 cm square ground plane ranges from approximately −2.3 dB at 2400 MHz, rising to a local maximum of approximately −1.5 dB at approximately 2500 MHz, then decreasing to a value of approximately −2.2 dB at 2500 MHz. For the 20 cm×20 cm square ground plane, the average gain is approximately −2.0 dB at 2400 MHz, rising to a local maximum of approximately −1.4 dB at between 2420 MHz and 2450 MHz, then decreasing to a value of approximately −2.0 dB at 2500 MHz. For the 30 cm×30 cm square ground plane, the average gain is approximately −2.4 dB at 2400 MHz, rising to a local maximum of approximately −1.5 dB at approximately 2500 MHz, then decreasing to a value of approximately −2.1 dB at 2500 MHz.

Figure 16:
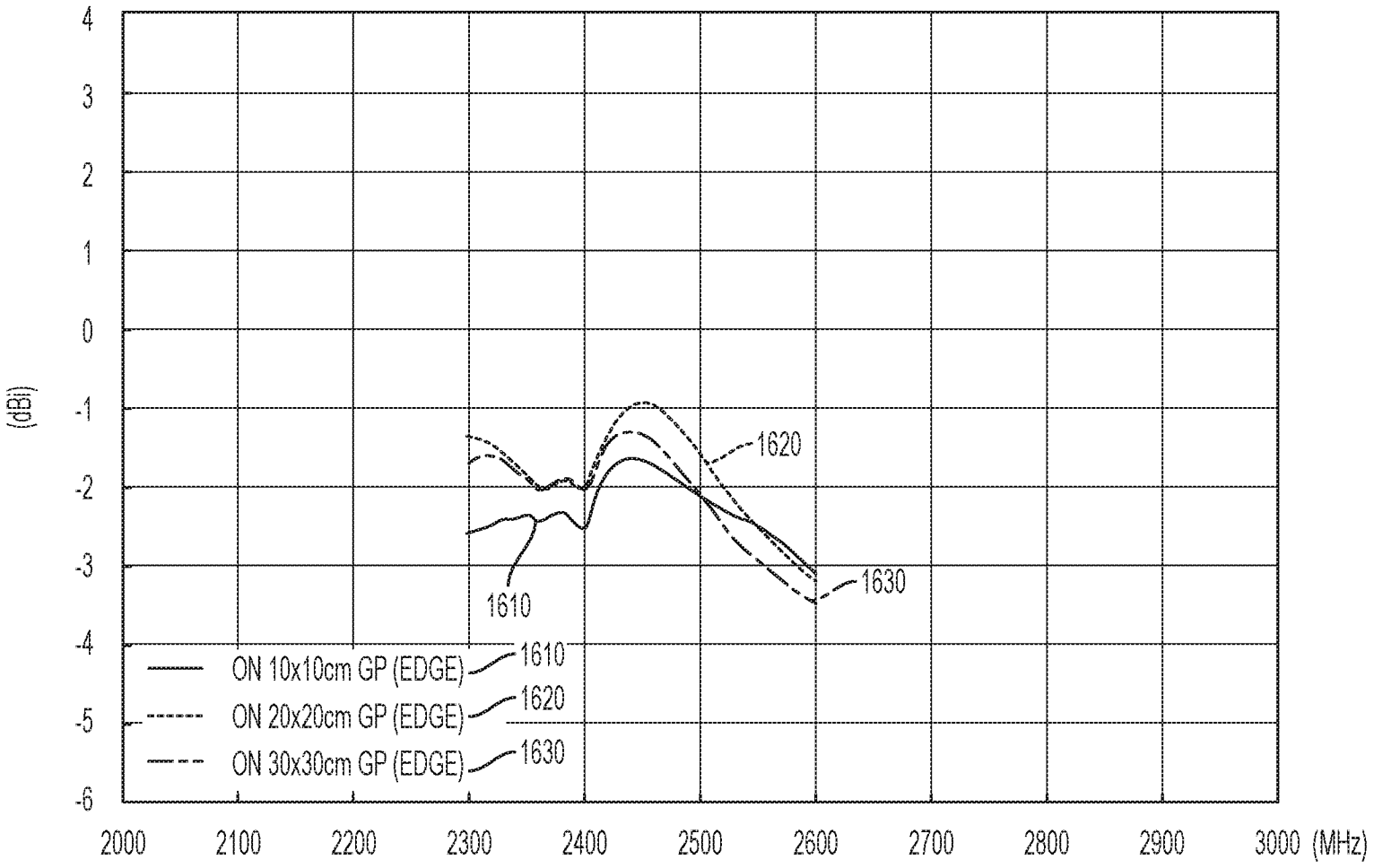
FIG. 16 is a plot of the measured average gain at the edge of the ground plane for an antenna according to the disclosure.

FIG. 16 is a graph of the average gain of the antenna measured at the edge of the ground plane for three different ground planes, measuring 10 cm×10 cm square 1610, 20 cm×20 cm square 1620, and 30 cm×30 cm square 1630, across the frequency range between 2300 MHz and 2600 MHz. For the 10 cm×10 cm square ground plane, the average gain is approximately −2.6 dB at 2400 MHz, rising to a local maximum of approximately −1.7 dB at approximately 2440 MHz, then decreasing monotonically to a value of approximately −2.1 dB at 2500 MHz. For the 20 cm×20 cm square ground plane, the peak gain is approximately −2.0 dB at 2400 MHz, rising to a local maximum of approximately −0.9 dB at approximately 2450 MHz, then decreasing to a value of approximately −1.6 dB at 2500 MHz. For the 30 cm×30 cm square ground plane, the average gain is approximately −2.0 dB at 2400 MHz, rising to a local maximum of approximately −1.4 dB at approximately 2440 MHz, then decreasing to a value of approximately −2.1 dB at 2500 MHz.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. An antenna comprising:

a circuit board comprising a first major surface and a second major surface opposite the first major surface;

the circuit board defining a connector aperture for a signal feed line, the connector aperture extending between the first major surface and the second major surface, the connector aperture being offset from a center of the circuit board towards a first near edge of the circuit board;

a patch element formed on the first major surface and extending at least between the connector aperture and the first near edge; at least one ground connector element formed on the second major surface in register with the patch element;

at least one via connecting the patch element to the at least one ground connector element;

a coaxial connector comprising a signal feed line and a connector collar, the connector collar cofacing the second major surface and being fixed to the at least one ground connector element and the signal feed line extending through the connector aperture and being electrically connected to a connector pad on the first major surface;

a radiating element formed on the first major surface and comprising a meander line trace having a meander line portion connected at a first positon to the connector pad, the radiating element extending laterally with respect to the coaxial connector away from the near edge of the circuit board so that the meander line trace may radiate in free space.

2. The antenna according to claim 1 wherein the radiator element is arranged to operate in a 2.4 GHz WiFi band.

3. The antenna according to claim 1 wherein the circuit board is generally oblong, the first near edge comprising a short edge.

4. The antenna according to claim 3 wherein the circuit board is less than approximately 40 mm in length and less than approximately 30 mm in width.

5. The antenna according to claim 3 wherein the patch element substantially surrounds the connector aperture in a direction between the aperture and the first short edge and first and second longer edges of the circuit board.

6. The antenna according to claim 5 comprising a plurality of vias connecting the patch element to the ground connector the vias being distributed in a U-shaped pattern around the connector pad.

7. The antenna according to claim 6 wherein the at least one ground connector element comprises a plurality of rectangular pads, each in register with one or more of the plurality of vias.

8. The antenna according to claim 1 wherein a dielectric of the circuit board substrate, a gap between the connector pad and the patch element and a thickness of the connector pad extending to the first position are chosen to match the impedance of the antenna with a transceiver circuit.

9. The antenna according to claim 1 wherein the circuit board is encapsulated in dielectric material.

10. The antenna according to claim 1 wherein the coaxial connector is any one of a Subminiature version A (SMA), micro-miniature coaxial (MMCX) or micro-coaxial (MCX) male connector.

11. The antenna according to claim 1 wherein the connector collar is solder fixed to the ground connector.

12. The antenna according to claim 1 wherein the signal feed line is soldered to the connector pad.

13. The antenna according to claim 1 wherein the antenna comprises a planar inverted F antenna (PIF A) and wherein the meander line portion is connected at a second location to the patch element.

14. The antenna according to claim 1 wherein the antenna comprises one of a meandered monopole or dipole structure.

15. The antenna according to claim 1 wherein the circuit board comprises a printed circuit board.

* * * * *